United States Patent [19]

Minari

[11] Patent Number: 4,899,552

[45] Date of Patent: Feb. 13, 1990

[54] REFRIGERATING SYSTEM FOR ICE MAKING MACHINE

[75] Inventor: Katsunobu Minari, Toyoake, Japan

[73] Assignee: Hoshizaki Electric Co., Ltd., Toyoake, Japan

[21] Appl. No.: 353,402

[22] Filed: May 17, 1989

[30] Foreign Application Priority Data

May 30, 1988 [JP] Japan ..... 63-70347[U]

[51] Int. Cl.[4] ..... F25C 5/10

[52] U.S. Cl. ..... 62/352; 62/222

[58] Field of Search ..... 62/352, 73, 222 X, 223, 62/278

[56] References Cited

U.S. PATENT DOCUMENTS

| | | | |
|---|---|---|---|
| 2,730,865 | 1/1956 | Murdock | 62/352 X |
| 3,264,837 | 8/1966 | Harnish | 62/222 X |
| 3,350,895 | 11/1967 | Harnish | 62/278 X |
| 3,386,259 | 6/1968 | Kirkpatrick | 62/278 X |
| 3,922,875 | 12/1975 | Morris, Jr. | 62/352 X |

OTHER PUBLICATIONS

Modern Refrigeration and Air Conditioning, Althouse et al, 1979, pp. 159–160.

*Primary Examiner*—William E. Tapolcai

*Attorney, Agent, or Firm*—Brooks Haidt Haffner & Delahunty

[57] ABSTRACT

A refrigerating system for an ice making machine includes an external equalizer expansion valve having a pressure equalizing tube connected to an exit of an evaporator tube. A pressure adjusting pipe which becomes conductive only in deicing cycle is branched from the pressure equalizing tube and connected to the discharge side of a compressor. An on-off valve is installed in the pressure adjusting pipe and controllably communicated with a hot gas valve in a hot gas pipe so that both the valves are opened and closed simultaneously. Namely, when the hot gas valve is opened for carrying out the deicing cycle operation, the on-off valve of the pressure adjusting pipe is opened, while the expansion valve remains closed. In an ice making operation cycle during which the hot gas valve is closed, the on-off valve of the pressure adjusting pipe is also closed. Thus, the expansion valve is optimally opened and closed for adjusting the amount of the coolant supply.

3 Claims, 4 Drawing Sheets

REFRIGERATING SYSTEM FOR ICE MAKING MACHINE

BACKGROUND OF THE INVENTION

1. Field of the Invention

The present invention relates to an ice making machine including a refrigerating system equipped with a hot gas pipe.

2. Description of the Prior Art

Referring now to FIG. 5 of the accompanying drawings, which shows a refrigerating system and an icing water circulating circuit in a conventional automatic ice making machine of a water flow-down type, a high temperature and high pressure coolant discharged from a compressor 11 of the refrigerating system generally denoted by 10 is condensed when passing through a condenser 12 during an ice making cycle. The condensed coolant is expanded through an expansion valve 13 and evaporated within an evaporator tube 14 while depriving the icing water of heat to be subsequently fed back to the compressor 11. The icing water (i.e. raw material water to be formed into ice) is sprayed over the outer surfaces of ice forming plates 31 and 32 of an ice making unit 30 from a water circulating pipe 21 constituting a part of the water circulating circuit 20. In the course of circulation of the icing water as well as the coolant, the temperature of the former is lowered, ultimately resulting in ice pieces or pellets 1 being formed on the outer surfaces of the ice forming plates 31 and 32, as indicated by double dotted lines.

On the other hand, in the deicing operation cycle, a hot gas valve 41 installed in a hot gas pipe 40 is opened, whereby the high temperature and high pressure coolant (gas) discharged from the compressor 11 is directly introduced into the evaporator tube 14, while a water feed valve 27 communicated with an external water service system is opened to supply tap water between the ice forming plates 31 and 32. consequently, those portions of ice pieces 1, which are in contact with the outer surfaces of the ice forming plates 31 and 32, are heated and melted under the action of both the high temperature and high pressure coolant and the tap water supplied from the external water service system, allowing the ice pieces to drop within an ice storage box (not shown).

In the ice making cycle of the automatic ice making machine, the temperature and pressure of the coolant prevailing at the exit of the evaporator tube 14 and hence at the suction port of the compressor 11 are susceptible to the influence of ambient temperature. More specifically, the external conditions (such as the temperature of the icing water, the ambient temperature and others) for the evaporator tube 14 which extends through the ice making unit 30 undergo remarkable changes. In that case, the compressor 11 may be considerably overloaded, when the coolant is placed under a high pressure due to increased evaporation. Under these circumstances, the temperature and the pressure of the coolant are measured by means of a temperature sensor **13*a* (disposed on the exit end of the evaporator tube 14) and an external equalizer tube 13*b* so that the opening and closing of the external equalizer expansion valve 13** is controlled on the basis of the measurements.

In the case of the automatic ice making machine described above, the external equalizer expansion valve 13 is opened when the pressure of the coolant at the exit or outlet of the evaporator tube is relatively low.

With the arrangement as described above, the temperature of the coolant prevailing at the exit of the evaporator tube tends to become high when the high temperature coolant (gas) is supplied directly to the evaporator tube in the deicing or defreezing operation cycle. Besides, when the ambient temperature is lowered, the pressure within the refrigerating system becomes relatively low to such an extent that the temperature and pressure conditions for opening the expansion valve are satisfied. Thus, the expansion valve is opened notwithstanding the defreezing or deicing cycle. If such a situation occurs, low temperature liquid coolant may undesirably flow into the evaporator tube 14, whereby the defreezing operation for removing the ice pieces is rendered difficult or even impossible creating serious problems.

SUMMARY OF THE INVENTION

It is a principal object of the present invention to provide a refrigerating system for an ice making machine which can remove the problems of the prior art sytem as described above.

In view of the above and other objects which will become more apparent as description proceeds, according to an aspect of the present invention, a refrigerating system for an ice making machine is proposed, wherein a pressure equalizer pipe extending from an external equalizer expansion valve in the refrigerating system is connected to the exit or outlet side of an evaporator tube, and a pressure adjusting pipe adapted to become conductive only during a defreezing or deicing cycle is branched from the pressure equalizer pipe to be connected to the discharge side of a compressor. The pressure adjusting pipe may be provided between a hot gas pipe bypassing the condenser and the expansion valve in the refrigerating system and the equalizer pipe. The pressure adjusting pipe includes therein an on-off valve controllably communicated with a hot gas valve in the hot gas pipe to allow these valves to be simultaneously opened or closed.

In the refrigerating system according to the present invention, the on-off valve in the pressure adjusting pipe is opened when the hot gas valve is opened for effectuating the defreezing operation cycle. As a consequence, the high pressure of the coolant prevailing on the discharge side of the compressor is applied on the equalizer pipe of the expansion valve. Thus, the expansion valve can remain in the closed state. Accordingly, only a high temperature and high pressure coolant can stably flow into the evaporator tube of the ice making unit to thereby melt those portions of the ice pieces which are in contact with the surfaces of the ice forming plates.

In the icing (i.e. ice making) operation cycle during which the hot gas valve is maintained in the closed state, the on-off valve in the pressure adjusting pipe is also closed, whereby the pressure of the coolant prevailing at the exit of the evaporator tube is transmitted to the expansion valve through the equalizer pipe. Consequently, the expansion valve is correspondingly actuated to adjust the amount of coolant supply thereby suitably controlling the evaporation.

BRIEF DESCRIPTION OF THE DRAWINGS

A preferred embodiment of the invention will now be described, by way of example only, with reference to the accompanying drawings, in which.

DESCRIPTION OF THE PREFERRED EMBODIMENT

Now, the invention will be described in detail in conjunction with a preferred embodiment thereof by reference to the accompanying drawings in which like reference symbols denote like or equivalent parts.

Figure 1:
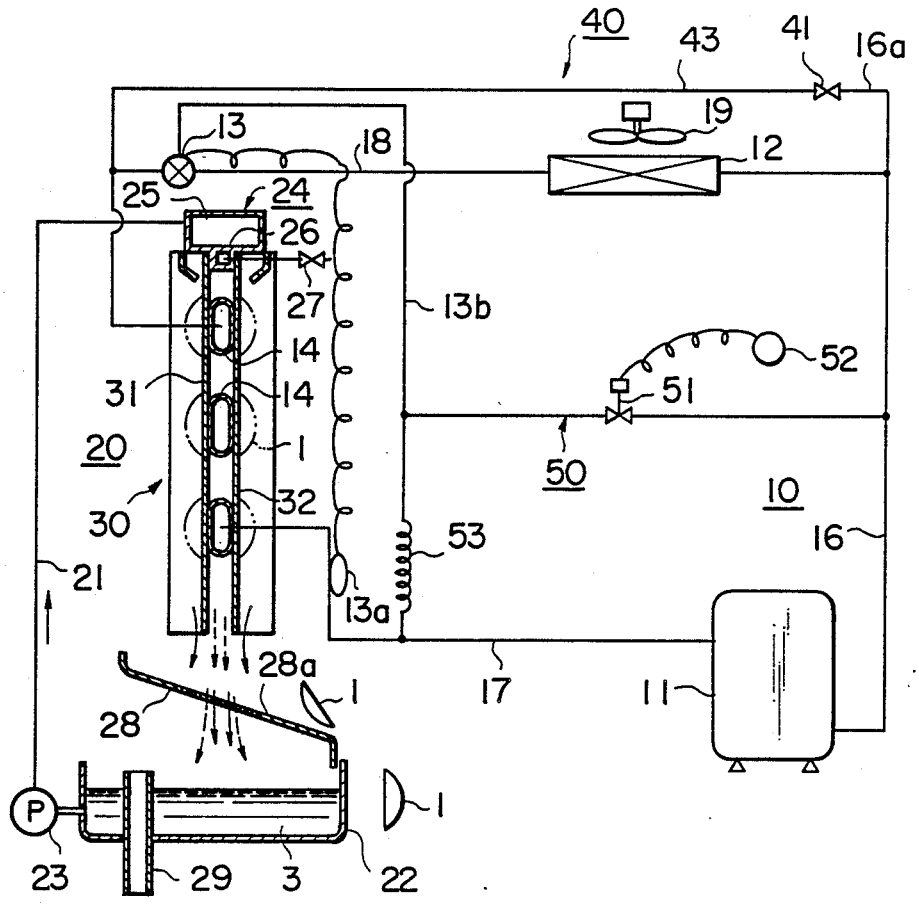
FIG. 1 is a schematic diagram showing a general arrangement of a refrigerating system according to an embodiment of the present invention.

In FIG. 1 which shows a general arrangement of the refrigerating system according to an embodiment of the present invention, a main refrigerating circuit generally denoted by a reference numeral 10 includes a compressor 11, a condenser 12, an external equalizer expansion valve 13 and an evaporator tube 14 as well as a discharge pipe 16, a suction pipe 17 and a connecting pipe 18 for interconnecting the abovementioned components in such a manner as can be seen in FIG. 1. A branch tube **16*a* branched from the discharge pipe 16 is connected to a hot gas valve 41 from which a bypass pipe 43 extends to the exit of the expansion valve 13. The branch pipe 16*a* and the bypass pipe 43 constitute together a hot gas pipe generally denoted by a numeral 40**.

In the icing (ice making) operation mode, a high temperature and high pressure coolant gas resulting from the compression by the compressor 11 flows into the condenser 12 through the discharge pipe 16 to be condensed under action of the air fed from a cooling blower 19. The liquid coolant then flows into the expansion valve 13 and undergoes evaporation within the evaporator pipe 14 while depriving the ambience of heat. The evaporated coolant is fed back into the compressor 11 through the suction tube 17 to be compressed again therein. During the ice making operation, the coolant continues to circulate through the main refrigerating circuit 10 in the manner as described above.

An external equalizer tube **13*b* extending outwardly from the expansion valve 13 is connected through a capillary tube 53 to the suction pipe 17 at a position nearer to the evaporator tube 14 and additionally communicated to the discharge pipe 16 through a pressure adjusting pipe 50 having an electromagnetically actuated on-off valve 51** therein, which valve is adapted to be maintained in the closed state (off) during the ice making operation.

Figure 2:
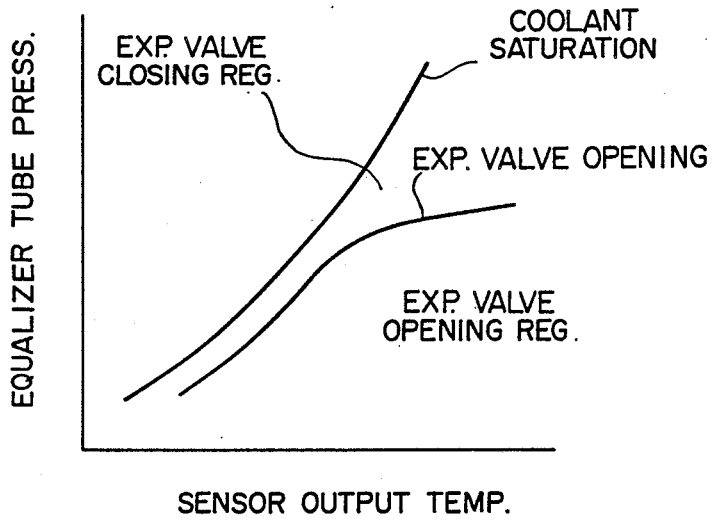
FIG. 2 is a view for graphically illustrating operations of the system shown in FIG. 1.

Consequently, the pressure of the coolant within the suction tube 17 acts on the expansion valve 13 through the external equalizer tube **13*b*. Thus, the opening or closing of the expansion valve 13 is controlled in response to the temperature detected by a temperature sensor 13*a* attached to the outer surface of the suction pipe 17. As is illustrated in FIG. 2, when the level of the temperature detected by the temperature sensor 13*a* and that of the pressure within the equalizer tube 13*b* lie within an opening region for the expansion valve 13, the latter is controlled to be opened to allow the liquid coolant to flow into the evaporator tube 14. As a consequence, the amount of the coolant evaporated within the evaporator tube 14 is increased, which in turn causes the output temperature of the temperature sensor 13*a* to be lowered while increasing the pressure within the equalizer tube 13*b*. Consequently, the pressure and temperature conditions enter a closing region for the expansion valve 13, whereby the latter is closed. The closure of the expansion valve 13 brings about decrease in the amount or flow of the coolant within the evaporator tube 14, which again results in the temperature rise detected by the temperature sensor 13*a* with the pressure within the pressure equalizer tube 13*b* being lowered. This situation means that the expansion valve opening region has been reached. Thus, the expansion valve 13** is again opened.

Describing the flow of water (icing water 3) during the ice making cycle, the icing water (i.e. raw material water to be utilized in forming ice) 3 contained in a water tank 22 is drawn up by a water circulating pump 23 to be fed to a composite water distributor 24 through a water circulating pipe 21.

Figure 3:
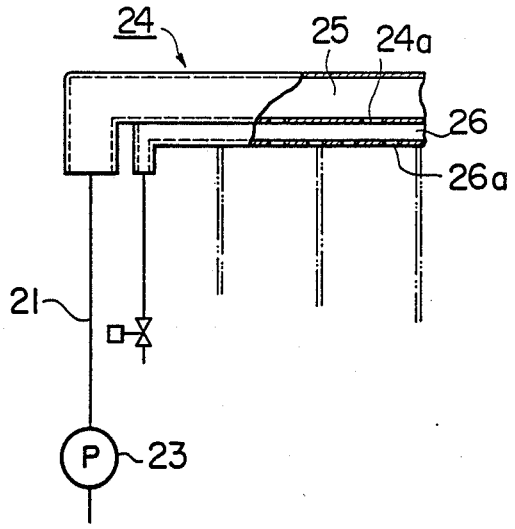
FIGS. 3 and 4 are a fragmentary side view and a fragmentary perspective view showing parts of the system of FIG. 1, respectively.

Referring to FIGS. 1 and 3, the combined water distributor 24 is composed of an icing water distributor 25 and a deicing water distributor 26, in which water outlet nozzles or orifices **25*a* and 26*a* are provided in an equispaced relationship, respectively. The deicing water distributor 26 is communicated with an external water service system by way of a water-feed valve 27**.

Figure 4:
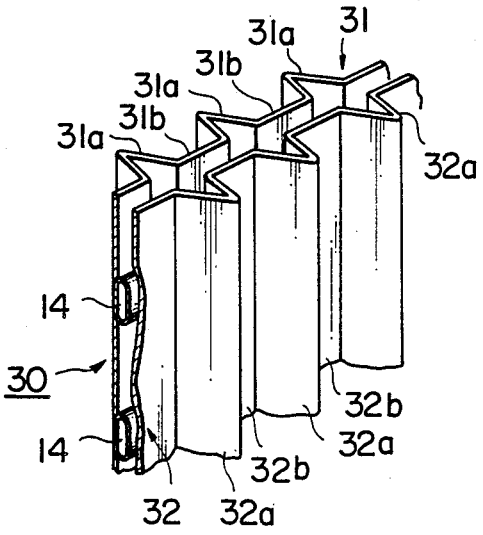
Figure 5:
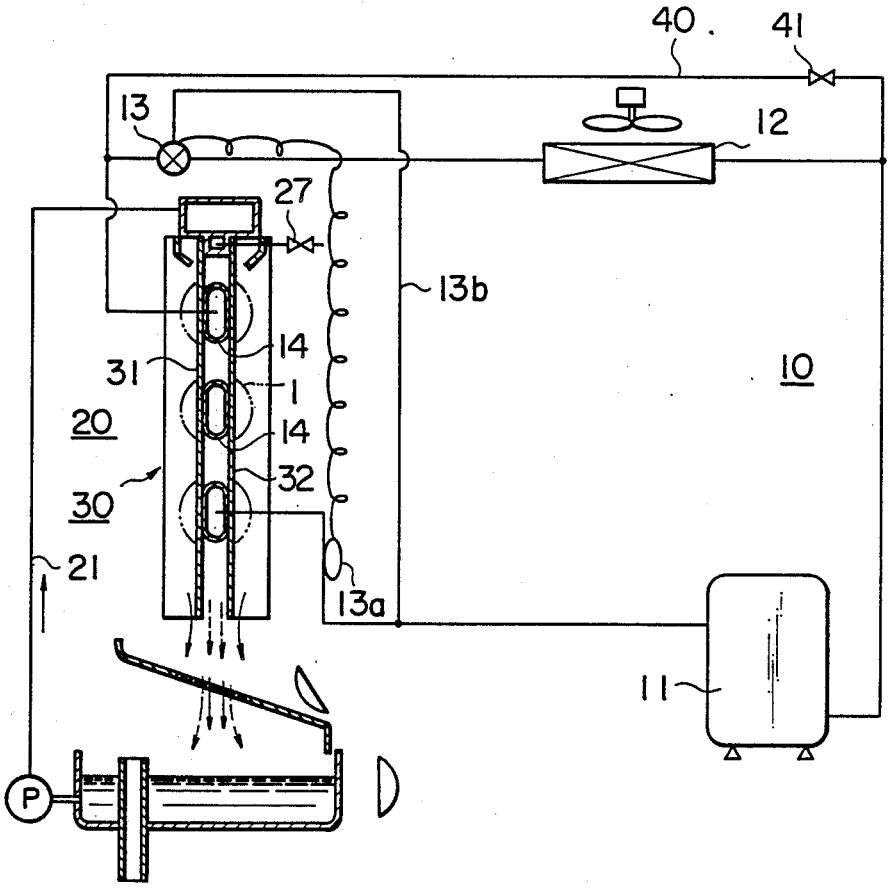
FIG. 5 PRIOR ART
FIG. 5 is a view, similar to FIG. 1, showing a conventional refrigerating system for an ice making machine.

The icing water fed to the combined water distributor 24, as described above, flows into the icing water distributor 25 to be distributed over the ice making unit unit 30 from the outlet orifices **25*a*. A structure of the ice making unit 30 is shown in detail in FIG. 4, from which it can be seen that ice forming plates 31 and 32 are combined together with the backs thereof facing in opposition to each other so as to sandwich therebetween the evaporator tube 14 used as a cooling pipe. The ice forming plates 31 and 32 formed of a material having a low thermal conductivity such as stainless steel or the like are configured or shaped symmetrically to each other, wherein these plates 31 and 32 are integrally formed with pluralities of angular protrusions 31*a* and 32*a*, respectively, with a predetermined distance between adjacent protrusions. Surface regions each defined between the adjacent angular protrusions 31*a* and 32*a*, respectively, serve as ice forming surfaces 31*b* and 32*b*, respectively. The icing water is distributed on these ice forming surfaces. In this conjunction, guide means may be provided below the combined water distributor 24 so that the icing water distributed through the orifices 24*a* can preferably be directed onto the ice forming surfaces 31*b* and 32*b***.

As described previously, the icing water distributed over the icing unit 30 flows downwardly on and along the ice forming surfaces **31*b* and 32*b* to be fed back to the icing water tank 22 flowing through perforations 28*a* formed in a water separating plate 28. The icing water 3 is again drawn up by the pump 23 for repeating the cycle described above. Excess icing water is discharged through an overflow pipe 29 to thereby maintain the upper limit of the water level within the tank. The coolant in the main refrigerating circuit 10 is evaporated within the evaporator tube 14, whereby the icing water flowing downwardly is deprived of heat. Consequently, the temperature of the icing water is lowered progressively to form the ice pieces 1**.

The icing cycle proceeds in this manner. When the ice pieces 1 have grown to a desired or predetermined size, an icing completion detecting device of a type known heretofore (not shown) is actuated, whereby an icing completion signal is generated.

In response to the icing completion signal, the cooling blower 19 and the circulating pump 23 are stopped while the hot gas valve 41 and the tap water valve 27 are opened. Simultaneously, the on-off valve 51 installed in the pressure adjusting pipe 50 is opened. Thus, the ice removing (i.e. deicing) operation cycle is started.

During the ice removing or deicing cycle, the coolant discharge pressure of the compressor 11 acts on the expansion valve 13 through the pressure adjusting pipe 50 and the pressure equalizer tube **13*b* such that the expansion valve 13 remains closed. Since the hot gas valve 41 is opened, high temperature coolant gas flows straight into the evaporator tube 14 to heat the ice forming plates 31 and 32 from the respective back sides. The tap water supplied from the external water service system through the water feed valve 27 and having a relatively high temperatue (when compared with that of the ice piece 1) flows into the deicing water distributor 26 to be distributed between the ice forming plates 31 and 32 from the outlet orifices 26*a*. The deicing water distributed in this manner flows downwardly on and along the rear surfaces of the angular protrusions 31*a* and 32*a* to finally reach the tank 22 after transversing the water separating plate 28 through the perforations 28*a*. When the deicing water within the tank 22 has attained an amount required by the succeeding icing cycle, excess water is discharged through the overflow pipe 29**.

Under the cooperative action of the high-temperature coolant gas and the deicing water as described above, the temperature of the ice forming plates 31 and 32 is raised. As a result, those portions of the ice pieces 1 which are in contact with the ice forming surfaces **31*b* and 32*b* are melted to allow the ice pieces 1 to drop onto the water separating plate 28. However, water resulting from the melting and deposited on the removed ice pieces drops through the plate 28 into the icing water tank 22. Thus, only the ice pieces 1 are introduced into the ice storage box (not shown) being guided by the water separating plate 28. When all the ice pieces 1 are removed and stored in the ice storage box, this is detected by a deicing completion detecting device of a known type (not shown), whereby a deicing completion signal is generated. In response to this signal, the hot gas valve 41, the tap water feed valve 27 and the on-off valve 51** are closed, whereupon the operation is shifted to the icing cycle.

During the deicing cycle, the capillary tube 53 allows the high pressure prevailing within the equalizer tube **13*b* to be gradually transferred to the suction pipe 17. When the pressure and the temperature are high, the on-off valve 51 is closed in response to a signal generated by a pressure switch or thermoswitch 52 provided in association with the valve 51 to thereby prevent an excessively high discharge pressure from acting on the expansion valve 13**.

In the foregoing description of the preferred embodiment of the invention, it has been assumed that the pressure adjusting pipe 50 is connected to the discharge pipe 16. However, similar function and effects can be obtained even when the pressure adjusting pipe 50 is connected to the bypass pipe 43. Further, since the expansion valve 13 may be supplied through the equalizer tube **13*b* with a higher pressure than the pressure in the coolant saturation region (see FIG. 2), the pressure adjusting pipe 50 may be connected to the exit of the condenser 12 in place of connection to the discharge port of the compressor 11** on the side of the entrance to the condenser as described hereinbefore in conjunction with the illustrated embodiment.

By virtue of such inventive arrangement employing the external equalizer thermostatic expansion valve, wherein the pressure equalizer tube thereof is communicated with the coolant compressor on the discharge side thereof through the pressure adjusting pipe which becomes conductive only in the deicing operation, the deicing as well as the icing operation can be carried out with an enhanced efficiency. More specifically, in the deicing cycle, only high temperature coolant gas is allowed to stably flow into the evaporator tube independent of the external conditions to thereby promote efficient deicing operations, which in the icing cycle, the expansion valve is caused to open and close in an optimal manner for holding the suction or intake pressure of the compressor at an optimal level, whereby the icing operation can also be performed efficiently.

It is thought that the invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What is claimed is:

1. A refrigerating system for an ice making machine including an ice making unit, said system comprising:

a main refrigerating circuit including therein a compressor, a condenser, an external equalizer expansion valve having a pressure equalizing tube connected thereto, and an evaporator tube, wherein pressure of a coolant prevailing at an exit of said evaporator tube mounted in the ice making unit is placed in communication with said expansion valve by way of said pressure equalizing tube so that opening and closing of said expansion valve is controlled in accordance with temperature and pressure of the coolant prevailing at the exit of said evaporator tube;

a hot gas pipe bypassing said pressure equalizing tube and having a hot gas valve incorporated therein; and a pressure adjusting pipe branched from said pressure equalizing tube at an intermediate portion thereof and communicated to the discharge side of said compressor, said pressure adjusting pipe including an on-off valve opened in correspondence with opening operation of said hot gas valve.

2. A refrigerating system for an ice making machine according to claim 1, wherein said pressure adjusting pipe is interposed between a portion of said hot gas pipe located downstream of said hot gas valve and said pressure equalizing tube.

3. A refrigerating system for an ice making machine according to claim 1, wherein said pressure adjusting pipe is interposed between the exit of said condenser and said pressure equalizing tube.

* * * * *